United States Patent [19]

Roeder

[11] 4,293,283

[45] Oct. 6, 1981

[54] JET WITH VARIABLE THROAT AREAS USING A DEFLECTOR

[76] Inventor: George K. Roeder, P.O. Box 4335, Odessa, Tex. 79760

[21] Appl. No.: 99,841

[22] Filed: Dec. 3, 1979

Related U.S. Application Data

[63] Continuation-in-part of Ser. No. 803,977, Jun. 6, 1977, Pat. No. 4,183,722.

[51] Int. Cl.[3] ..... F04F 5/00

[52] U.S. Cl. ..... 417/172; 166/106

[58] Field of Search ..... 417/172, 170, 151, 185, 417/167, 76, 84, 89, 174; 166/106

[56] References Cited

U.S. PATENT DOCUMENTS

| | | | |
|---|---|---|---|
| 121,376 | 11/1871 | Jamison | 417/151 |
| 1,258,418 | 3/1918 | Kemble | 417/172 |
| 1,372,150 | 3/1921 | Lang | 417/170 |
| 2,080,623 | 5/1937 | McMahon | 417/172 X |
| 4,135,861 | 1/1979 | Brown et al. | 417/172 X |
| 4,183,722 | 1/1980 | Roeder | 417/172 |

*Primary Examiner*—Carlton R. Croyle
*Assistant Examiner*—Edward Look
*Attorney, Agent, or Firm*—Marcus L. Bates

[57] ABSTRACT

A downhole pump of the jet type for use in a borehole in order to produce fluid from the wellbore by employment of a power fluid source located above the surface of the ground. The power fluid flows through the jet pump assembly to cause a pumping action. The jet pump includes a suction chamber formed about a nozzle assembly. The nozzle is spaced from a venturi throat. The venturi throat diverges in a direction away from the nozzle. A deflector device is arranged concentrically with the nozzle and venturi. One end of the deflector is supported by the pump body, and a reduced convergent marginal free end is received within the divergent venturi throat, thereby forming an annulus between the throat and the deflector. The annular area increases in a downstream direction respective to the nozzle. The power fluid exits from the nozzle and enters the inlet of the venturi, causing produced fluid to be pulled into the throat entrance. The mixed fluids continue to flow through the throat and about the deflector and out of the venturi as the fluids are forced to continue through the pump and then to the surface of the earth. The deflector causes the power fluid to act against a greater surface area thereby utilizing all of the power fluid to its maximum advantage.

6 Claims, 5 Drawing Figures

FIG. 1
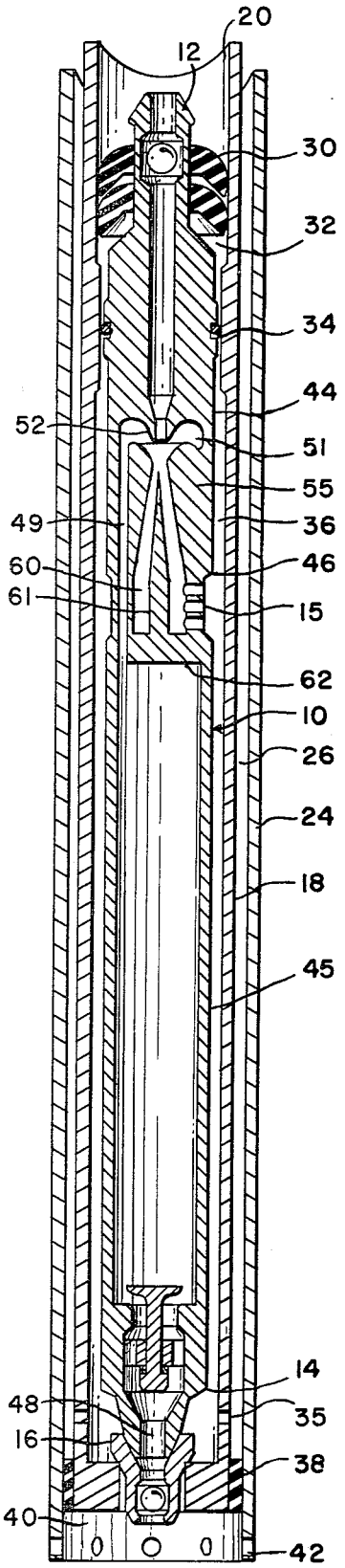
FIG. 2
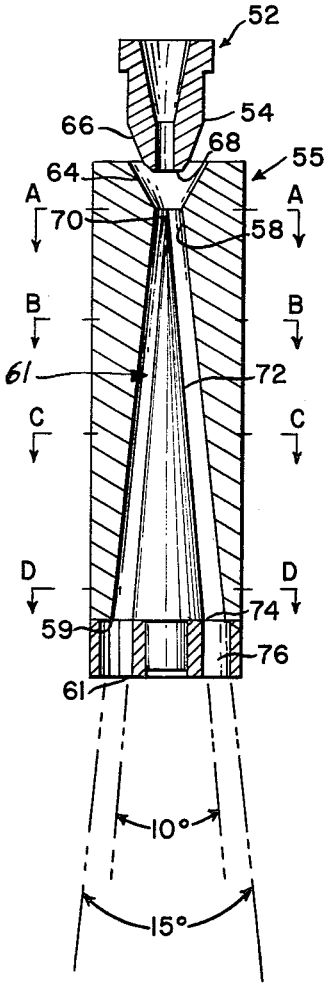
FIG. 3
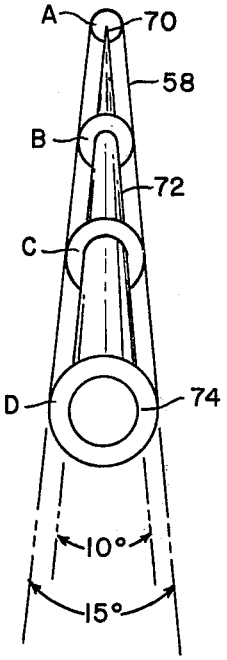
| Throat Areas | | |
|---|---|---|
| A | .02761 | in.$^2$ |
| B | .07898 | " |
| C | .14521 | " |
| D | .21143 | " |
FIG. 5
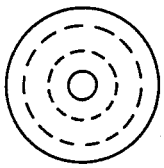
FIG. 4

JET WITH VARIABLE THROAT AREAS USING A DEFLECTOR

REFERENCE TO RELATED PATENT APPLICATION

My previous patent application Ser. No. 803,977 filed June 6, 1977 entitled "DOWNHOLE JET PUMPS" now U.S. Pat. No. 4,183,722, of which this patent application is a continuation-in-part.

PRIOR ART

Brown U.S. Pat. No. 3,781,134
McArthur et al U.S. Pat. No. 3,653,786
Coberly U.S. Pat. No. 2,812,723
Coberly U.S. Pat. No. 2,682,225
Jeffery U.S. Pat. No. 2,191,717
Burt U.S. Pat. No. 2,187,486
McMahon U.S. Pat. No. 2,114,905
McMahon U.S. Pat. No. 2,080,623
Wolff U.S. Pat. No. 2,041,803
McMahon U.S. Pat. No. 1,992,436
Martin U.S. Pat. No. 1,845,675
Overstreet U.S. Pat. No. 1,782,310
McMahon U.S. Pat. No. 1,642,121
Ehrhart U.S. Pat. No. 1,548,029
Lang U.S. Pat. No. 1,372,150
Lang U.S. Pat. No. 1,372,149
Kimble U.S. Pat. No. 1,258,418
Germany U.S. Pat. No. 1,160,602
Morison U.S. Pat. No. 1,055,210
Boetcher U.S. Pat. No. 801,641
Great Britain U.S. Pat. No. 735,866
Labadie U.S. Pat. No. 676,239
Guethler U.S. Pat. No. 636,333
Jamison U.S. Pat. No. 121,376

BACKGROUND OF THE INVENTION

This invention relates to downhole jet pumps having provisions by which high velocity power fluid is forced through a nozzle into a throat area which creates a suction in its wake. This invention provides an advantage over the present known jet pumps by the employment of a variable throat design having a deflector device which utilizes the normally wasted fluid motion located in the center of the jet stream.

The deflector device deflects the total fluid in the jet stream radially outwardly against the variable throat area in proportion to the pressure exerted by the surface power unit used to supply the power fluid to the jet nozzle. The greater the pressure exerted on the jet stream exiting the nozzle, the further up the deflector the suction action will occur. As the suction area in the variable throat is increased, the wake suction action also is increased.

The use of this type throat design allows employment of a larger diameter throat opening than was previously possible, while retaining a high efficient pumping action, all of which is a great advantage over other jet type pumps.

Another advantage of the deflector is to put the wasted fluid motion to work. As the deflector is moved back towards the nozzle, the fluid is deflected into a cone shaped mist, and it is this cone shaped mist action which is used to create the suction in the variable throat.

Since this throat does not employ any straight internal surface area in its bore, it is unlike any known jet pump which uses a deflector of any type.

The deflector throat relation of 10°–15° mentioned herein is merely a suggested figure and may vary according to the size of the pump and the volumes demanded. These angles may be changed according to the particular pump design and operational perimeters.

SUMMARY OF THE INVENTION

This invention teaches improvements in jet pumps, and in particular a jet pump having a concentrically arranged suction chamber, nozzle, venturi, and deflector. The suction chamber is formed about the nozzle and venturi inlet, and is connected to a formation fluid source so that when power fluid is forced to flow through the nozzle and into the venturi, the resulting stream of fluid entrains the formation fluid located within the suction chamber, so that mixed fluid flow occurs into the throat of the venturi.

The deflector is tapered in a direction towards the nozzle, and a marginal free end thereof is mounted within the discharge opening of the throat thereby leaving an annular area between the outer wall surface of the deflector and the circumferentially extending inner wall surface of the venturi throat; this annular area increases in a downstream direction, depending upon the relative angle of divergence of the venturi and deflector. Produced fluid and spent power fluid therefore flow from the discharge opening into a produced fluid outlet of the pump, where the comingled spent power fluid and the produced fluid are then forced to flow to the surface of the earth. Hence, the deflector cooperates with the discharge opening of the throat and with the nozzle in a manner to significantly increase the efficiency of operation of a jet pump apparatus.

Accordingly, a primary object of the present invention is the provision of improvements in downhole jet-type pumps.

Another object of the present invention is the provision of apparatus in conjunction with a jet-type pump which eliminates axial flow through the discharge opening of a venturi throat associated therewith.

A further object of this invention is to disclose and provide a jet-type pump having apparatus associated therewith which provides for flow of power fluid through the nozzle and into the throat entrance whereupon the flow is then forced into an annular configuration thereby eliminating axial flow through the discharge nozzle throat.

A still further object of this invention is the provision of improvements in downhole jet-type pumps for producing oil wells.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

BRIEF DESCRIPTION OF THE DRAWINGS

FIG. 1 is a broken, longitudinal, cross-sectional representation of the present invention operatively disclosed in conjunction with a hydrocarbon producing wellbore;

FIG. 2 is an enlarged, detailed, longitudinal, cross-sectional representation of part of the downhole jet pump of FIG. 1;

FIG. 3 is a diagrammatical, cross-sectional representation of a view taken along lines AA, BB, CC, and DD of FIG. 2;

FIG. 4 is an end view of FIG. 2; and,

FIG. 5 is a table of data related to FIGS. 2 and 3.

DETAILED DESCRIPTION OF THE PREFERRED EMBODIMENT

FIG. 1 illustrates one embodiment of a jet pump 10 made in accordance with the present invention. The pump includes a power fluid inlet 12 at the upper end thereof and a formation fluid inlet 48 located at the opposed end 14 thereof. Produced and spent power fluids are discharged through outlet port 15. Seating shoe 16 supportingly receives the lower end of the pump body in the same manner of a conventional downhole hydraulic pump, and provides a formation fluid inlet passageway thereinto.

Power oil tubing 18 conducts flow of fluid through the interior 20 thereof, and is supported from a wellhead (not shown). A supply of power fluid flows from a surface pump (not shown), downhole into the interior 20 of the tubing. Well casing 24 is concentrically arranged respective to the tubing and forms annulus 26 therebetween through which produced fluid and spent power fluid can flow up the borehole and out of the usual Christmas Tree located above the ground (not shown).

A packer nose assembly 30 separates annulus 32 from tubing interior 20, while seal ring 34 cooperates with the main body of the pump to separate annulus 36 from annulus 32. Ports 35 communicate the tubing annulus and casing annulus, 36 and 26, with one another. Packer device 38 anchors the lower end of the tubing string to the casing string and prevents the occurrence of fluid flow between annulus 26 and lower casing interior 40. Perforation 42 communicate a pay zone or production formation with the casing interior 40, thereby providing a source of formation fluid at production inlet 48.

As may be appreciated by those skilled in the art, the power fluid inlet 12 may be directly connected to the string of tubing for use with the present invention as a fixed type downhole pump; or, alternatively, the pump of this invention can be of the free type, such as disclosed in FIG. 1.

Upper sub 44 forms part of the main pump body and is connected to a barrel 45 which in turn is connected to an outlet sub 46, so as to enable the various components of the pump to be serviced. The details of this construction is considered within the comprehension of those skilled in the art.

Flow passageway 49 of the pump of FIG. 1 is connected to a suction chamber 51. Nozzle 52 is affixed to upper sub 44 and has a very hard metal alloy jet formed at the free end 54 thereof. The end 66 of the nozzle freely extends into the suction chamber and is spaced from venturi entrance 64 of the venturi assembly 55 and from the interior wall of the barrel. Venturi throat 58 is concentrically arranged respective to the nozzle and barrel and extends axially away from the entrance in a downstream direction as the throat diverges radially outwardly commencing at AA and terminating at lower end 59.

Discharge chamber 60 has a deflector 61 concentrically mounted therewithin, with the lower enlarged end of the deflector being affixed to the interior wall 62 of the venturi assembly, thereby leaving a free tapered end 72 of the deflector which extends axially uphole into proximity of the venturi entrance 64, as seen at 70. The venturi and deflector therefore jointly cooperate together in the illustrated manner of FIGS. 1–4 to form an annulus therebetween which is of varying cross-section.

The passageway 74, formed at the lower marginal end between the venturi throat and the deflector, continues at 76 into the annular chamber 60 which is connected to the before mentioned port 15 to form a produced fluid outlet for the pump.

As seen in FIGS. 2 and 3, the venturi has a throat which includes a circumferentially extending wall surface 58 in the form of a cone which is spaced from the tapered wall surface 72 of the deflector, thereby leaving an annular area therebetween. The conicity of wall surface 58 and the taper of the deflector are of slightly different angles so that the annulus formed therebetween increases in area, even with equal angles. As seen illustrated in FIGS. 2 and 3, the deflector is a cone of 10° taper while the walls of the venturi throat is arranged with a 15° taper. The arrows at A—A, B—B, C—C, and D—D coincide with areas a, b, c, d of FIG. 3 and illustrates the progressive enlargement of the annulus between the venturi throat and deflector.

The venturi entrance 64 is spaced from the nozzle outlet 68 so that formation fluid is sucked from the suction chamber 51 due to the velocity of the mass flow at 68 and 58.

Numerals 74 and 76 indicate the entrained fluid flow brought about by the suction of the high velocity stream at 68. Numeral 70 indicates the outermost free reduced end portion of the deflector which causes the power fluid, spent power fluid, and produced fluid to assume a toroidal or annular flow path. At numeral 74 most all of the power has been extracted from the power fluid, and the comingled spent power fluid and formation fluid exit the venturi at constant diameter part 76 and enter the discharge chamber 60.

In operation, as the power fluid moves into the entrance of the venturi, it commences to mix with the production fluid at 64, thereby sucking the production fluid from the suction chamber 51 into the throat 58. The power fluid which remains adjacent to the axial centerline of the throat ordinarily would be wasted energy in the absence of the deflector 61 because it cannot otherwise entrain any appreciable amount of the production fluid as noted in FIG. 3.

In order to move the power fluid from the relative inefficient central location into more intimate contact with the produced fluid, the deflector is employed in the illustrated manner of FIGS. 1–3. This new combination of elements increases the friction drag of the power fluid against the production fluid, thereby further increasing the suction which draws additional production into the venturi.

Progressively increasing the area of the annulus commencing at the apex 70 of the deflector and continuing through the venturi into the constant diameter chamber 76 places the power fluid in more intimate contact with the produced fluid, thereby significantly increasing the efficiency of the jet pump. This enables a greater production volume to be achieved at a lower operating pressure.

I claim:

1. A jet pump for producing a well comprising a main body having an axial bore formed therethrough; a power fluid inlet connected to said axial bore at one end of said main body, a nozzle axially aligned with said main body and having a jet end spaced from an inlet end, a suction annulus formed concentrically about the jet end of said nozzle and within said main body, said inlet end being connected to said power fluid inlet such that power fluid can flow into said inlet end, through the interior of said nozzle, and out of said jet end;

means, including a formation fluid inlet connected to the other end of said main body, which forms a flow passageway extending from the last said inlet into said suction annulus;

a venturi axially aligned with said nozzle and having an inlet end and an outlet end, said inlet end of said venturi being placed adjacent to said jet end of said nozzle, said venturi having sidewalls which describe a frustum of a cone;

a conical deflector having a large diameter end supported by said main body and a free end extending away therefrom and received within the venturi, with the apex of the deflector being positioned adjacent to the throat; with there being an annular passageway formed between the outer surface of the deflector and the inner surface of the venturi; an annular outlet chamber underlying and in communication with said annular passageway;

said annular passageway commences in proximity of the nozzle outlet and extends into communication with said annular outlet chamber; the area of said annular passageway increases in a downstream direction, a marginal length of said deflector extends through said annular outlet chamber;

an outlet port connected to said annular outlet chamber for conducting mixed fluid flow away from the pump and towards the surface of the ground.

2. The jet pump of claim 1 wherein said main body terminates in an upper sub, a packer nose assembly connected to said upper sub;

said power fluid inlet extends through said upper sub and into communication with said nozzle;

an inlet sub at the lower end of said main body, said annular outlet chamber being formed above said inlet sub; said outlet port being directly connected to said annular outlet chamber so that fluid flows from said annular passageway directly into said annular outlet chamber and then through said outlet port to a location externally of the pump.

3. The jet pump of claim 1 wherein said annular outlet chamber is formed about a lower marginal end of said deflector and below said venturi;

said deflector has a constant diameter marginal lower end which is supported by the lower end of said annular outlet chamber;

said outlet port directly connects the annular outlet chamber to conduct flow to a location externally of the pump.

4. A jet pump comprising; a main body having a power fluid inlet passageway at the upper end thereof, a formation fluid inlet passageway at the lower end thereof, and an outlet passageway through which spent power fluid and produced fluid may flow;

a nozzle mounted within said main body, said nozzle having an inlet connected to said power fluid inlet passageway;

an annular suction chamber formed within said main body, means forming a passageway connecting said suction chamber to said formation fluid inlet passageway;

a venturi mounted within said main body, a throat formed within said venturi, said venturi having an entrance and a diverging discharge opening, said throat being axially aligned with and spaced from said nozzle, said nozzle having an outlet adjacent to said entrance, said annular suction chamber being formed about the nozzle outlet and the venturi entrance;

a deflector having a fixed end opposed to a reduced free end, means mounting said fixed end to said main body with said reduced free end being received within said venturi in spaced relation thereto, thereby forming an annular passageway therebetween which increases in area in a downstream direction, and means connecting said annular passageway to said outlet passageway;

said main body terminates in a upper sub; said power fluid inlet passageway extends through said upper sub into communication with said nozzle;

an outlet sub located at a medial marginal length of said main body, said outlet passageway being formed within said outlet sub, so that fluid can flow from said annular passageway to a location externally of the pump.

5. The pump of claim 4 wherein the free marginal end of said deflector reduces in diameter in an upstream direction, an annular discharge chamber is formed about said deflector at a location below said venturi, said outlet passageway is connected to the interior of said annular passageway by means of said annular discharge chamber for conducting mixed fluid flow to a location externally of the pump.

6. The pump of claim 4 wherein said upper sub is connected to a packer nose assembly, and power fluid flows through the packer nose assembly into said power fluid inlet;

so that the pump can be circulated into and out of a borehole as a free type pump apparatus.

* * * * *